US006581776B2

(12) United States Patent
Zatkoff

(10) Patent No.: US 6,581,776 B2
(45) Date of Patent: Jun. 24, 2003

(54) CONVERTIBLE CLEANING KIT

(76) Inventor: Brian S. Zatkoff, 13986 Dancing Twig La., Gainesville, VA (US) 20155

( * ) Notice: Subject to any disclaimer, the term of this patent is extended or adjusted under 35 U.S.C. 154(b) by 26 days.

(21) Appl. No.: 09/986,835

(22) Filed: Nov. 13, 2001

(65) Prior Publication Data

US 2003/0089626 A1 May 15, 2003

(51) Int. Cl.[7] ..... B65D 69/00
(52) U.S. Cl. ..... 206/576; 206/223; 206/374
(58) Field of Search ..... 206/216, 223, 206/361, 362, 362.3, 374, 375, 576; 15/105, 144.3, 146, 184, 257.01

(56) References Cited

U.S. PATENT DOCUMENTS

| | | | | |
|---|---|---|---|---|
| 908,558 A | | 1/1909 | Gildmeister | |
| 1,913,105 A | | 6/1933 | Case et al. | |
| 3,600,740 A | | 8/1971 | Ogler | |
| 4,204,294 A | * | 5/1980 | Halverson | 15/185 |
| 4,979,525 A | * | 12/1990 | Chiou | 132/286 |
| 5,423,427 A | * | 6/1995 | Brown | 206/581 |
| 5,609,255 A | | 3/1997 | Nichols | |
| 5,661,868 A | * | 9/1997 | Panagakos et al. | 15/184 |
| 5,664,279 A | | 9/1997 | Vosbikian | |
| 5,909,832 A | * | 6/1999 | French et al. | 224/547 |
| 6,439,630 B1 | * | 8/2002 | Eatmon | 294/51 |

FOREIGN PATENT DOCUMENTS

JP 10-243821 * 10/1998

* cited by examiner

*Primary Examiner*—David T. Fidei

(57) ABSTRACT

A cleaning kit includes a housing member having a carrier and a convertible cover. A pivotal handle is fixed to the convertible cover, the pivotal handle being selectively folded against a surface of the convertible cover. At least one locking mechanism is provided for securing the convertible cover to the carrier and a plurality of holding clips are mounted on an inner surface of the carrier, the holding clips being provided for holding selected cleaning tools in a storage position. A telescoping handle is removably mounted in one of the plurality of holding clips as is the handle of at least one cleaning device. Each cleaning device includes an attachment head, a handle having a first end and a pivot end, and a pivot hinge positioned between the attachment head and the pivot end of the handle, the handle being selectively folded against the attachment head and in longitudinal alignment with the attachment head. The convertible cover selectively functions as either a cover or a dustpan.

13 Claims, 5 Drawing Sheets

CONVERTIBLE CLEANING KIT

BACKGROUND OF THE INVENTION

1. Field of the Invention

This invention relates to a compact and self-contained cleaning kit. More specifically, the present invention relates to a compact and self-contained cleaning kit having a convertible carrying case and component housing along with a variety of ready-to-use cleaning implements therein.

2. Description of Related Art

There are many types of compact cleaning devices and apparatus in the marketplace at the present time. There are many places where it is desirable to have cleaning implements available, such as the kitchen, a dorm room, camper, laundry room and other similar places. It has been found that a common problem in having cleaning devices available is a lack of space in which to store these implements, lending to clutter and misplaced items. In a kitchen, for example, many times there is no "broom closet" or pantry large enough to store a broom and a dust pan for even the most basic cleaning. In order to compensate for the lack of enough vertical storage, it becomes necessary to fit cleaning items in drawers or other inconvenient places where cleaning is needed. Other common storage locations for these necessary but at times overly large cleaning items include the corner of the laundry room, a corner of the garage, stacked along the basement step, slid in next to the refrigerator, and other similar places.

All of these common storage places for cleaning supplies such as a broom and a dust pan are inconvenient, and if they are visible storage locations, they can even be unattractive and embarrassing to the homeowner.

Previous attempts to provide compact cleaning kits have been deficient in many respects. First, these kits may allow the cleaning tools to remain exposed, even during storage, thus contributing to their soiling, possible contamination of the surrounding area, and early discard. One example of a cleaning device is shown in U.S. Pat. No. 3,600,740 to Ogler. Although a portion of the kit may be used for a dustpan in Ogler, the emptying of the dustpan is a problem since tipping of the "dustpan" will cause the cleaning tools to spill out of the kit. There are no instances where the dustpan is entirely functional as another element of the kit, for example, as the entire lid, thereby resulting compact and simple kit housing as occurs in the present invention. Even further, there are no known kits in which a short handle is provided already attached to the cleaning tool for small or quick cleaning jobs. Instead, the handles of the known kits are only attached directly to the cleaning tool per se. Alternatively, a full size handle is permanently attached to the cleaning tool. Each of these arrangements is contrary to the goal of a compact and durable cleaning kit as disclosed in the following.

Accordingly, a problem exists in the art whereby there is a need for a durable, portable cleaning kit capable of simple and efficient storage in even the most compact of spaces. The present invention solves this problem in the art by providing a compact cleaning kit in which certain cleaning items are broken down within a storage case, and a lid portion of the storage case itself is convertible into a dust pan simply by removing it from the remainder of the case. Use of the dust pan is achieved without disturbing the contents of the case or causing a disarray of any cleaning implements. Because the lid portion of the cleaning kit also functions as a dustpan, the number of parts to the kit is reduced, thereby enabling a more compact and self-contained kit. Further, the kit is portable to enable use in a number of locations and may be stored in almost any conceivable location.

SUMMARY OF THE INVENTION

Therefore, it is the object of this invention to provide a cleaning kit which is compact, durable, and convenient.

A further object of the present invention is to provide a cleaning kit in which cleaning components are broken down for storage within a kit housing.

Another object of the present invention is to provide a cleaning kit in which a use life of the cleaning implements will be extended as a result of a covered storage thereof.

Yet another object of the present invention is to provide a cleaning kit in which the tools thereof include self contained handles and at least one telescoping handle.

Still another object of the present invention is to provide a cleaning kit in which cleaning tools thereof are interchangeable on the telescoping handle.

A still further object of the present invention is to provide a cleaning kit in which the lid of the housing to the kit is removable and is also a dust pan.

Yet another object of the present invention is to provide a cleaning kit in which the housing includes only two parts, one of which is a lid/dustpan combination.

These and other objects of the present invention are achieved by providing a cleaning kit including a housing member having a carrier and a convertible cover. A pivotal handle is fixed to the convertible cover, the pivotal handle being selectively folded against a surface of the convertible cover. A locking mechanism is provided for securing the convertible cover to the carrier and a plurality of holding clips are mounted on an inner surface of the carrier, the holding clips being provided for holding selected cleaning tools in a storage position. A telescoping handle is removably mounted in one of the plurality of holding clips as is at least one cleaning device. The at least one cleaning device includes an attachment head, a handle having a first end and a pivot end, and a pivot hinge positioned between the attachment head and the pivot end of the handle, the handle being selectively folded against the attachment head and in longitudinal alignment with the attachment head. The convertible cover selectively functions as either a cover or a dustpan.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF PREFERRED EMBODIMENTS

Figure 1:
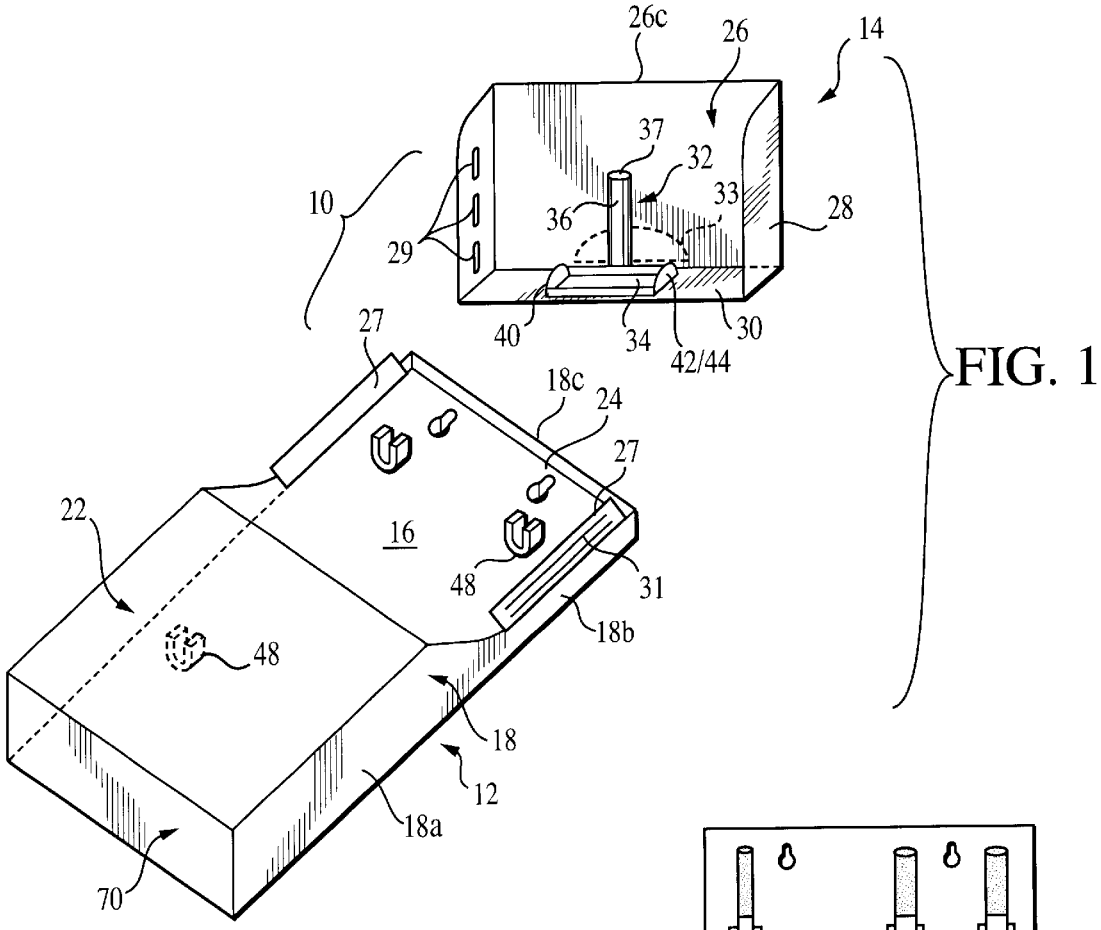
FIG. 1 is a perspective view of an opened cleaning kit according to a preferred embodiment of the present invention.

Referring first to drawing FIG. 1, there is illustrated a perspective view of the compact cleaning kit 10 according to the present invention, in an opened condition and free of cleaning tools for a clear view of the actual housing portion of the cleaning kit.

The cleaning kit 10 is formed as a housing and includes an implement carrying portion 12 and a convertible lid/dustpan portion 14. By way of explanation, the outside shape of the housing including the implement carrying portion 12 and the lid/dustpan portion, may be of any suitable shape to easily fit into small spaces. This includes the option of squared edges, rounded edges, a generally oval shape of the housing when assembled, a generally rectangular shape of the housing when assembled, or any other similar suitable shape.

It should be noted that the lid/dustpan portion 14 of the housing will occasionally be referred to as either a lid or a dustpan according to the use thereof at the time in the description thereof in the present disclosure. It is a unique feature of the present invention that an entirety of the lid is convertible to a dustpan without altering any remaining components of the housing, such as the implement carrying portion, or affecting the cleaning components housed therein as will be further described below. Details of the lid/dustpan structure 14 are as follows.

Referring first to the implement carrying portion 12 of the housing, it will be understood that the carrying portion 12 is intended to be more of a container type device and includes a rear wall 16 having an exposed portion and a generally covered portion, longitudinal sides 18 having a first width 18*a* and a second width 18*b*, a base 20, and a front wall section 22. It can be seen that the front wall section 22 extends approximately half the height of the rear wall 16 thereby defining the generally exposed portion and covered portions of the rear wall. The purpose of the front wall section 22 extending this predetermined distance is so that access may be had to accessories within the carrying portion 12 of the kit 10. The height of the front wall section 22 may vary, but in any event coincides with that portion of the rear wall 16 which is generally described as the covered portion of the rear wall.

The longitudinal sides 18 of the carrier 12 likewise substantially correspond to a transition between the exposed rear wall portion and the generally covered portion of the rear wall 16. In particular, the side walls 18 are shown to have a constant width at 18*a* to space the front wall 22 from the rear wall 16, and then slope down to a predetermined height 18*b* above the rear wall 16 and surrounding the exposed portion (or that not covered by the front wall 22) of the rear wall 16. At the portion of the rear wall 16 which would constitute the outermost edge thereof, the side walls 18 are shown to be connected by an additional wall 18*c*. This wall 18*c* is optional, as is the height of the side walls 18 at the reduced width portion 18*b*. Further, it will be understood that the side walls 18 may taper to a front planar surface of the rear wall 16 prior to reaching the uppermost edge of the rear wall 16, or may abruptly angle down to meet the rear wall 16 at the height of the front wall 22.

The rear wall 16 of the carrying portion 12 may additionally include openings 24 therein for hanging of the kit 10 on a wall or the like. The location, size and shape of the openings 24 will be determined in accordance with a proper balance of the kit 10 when the contents thereof are taken into consideration.

Turning now to the convertible lid/dustpan portion 14 of the kit 10, the following description is provided. The lid/dustpan portion 14 includes an operating surface 26, side walls 28, and an end wall 30. The operating surface 26 is that portion of the lid/dustpan 14 having the greatest surface area, and is the primary receiver of debris during cleaning. The side walls 28 and end wall 30 assist in confining debris to the operating surface 26 when the lid is being used as a dustpan.

Additionally, there is provided a dustpan handle member 32 pivotally mounted on an inner surface of the end wall 30 of the lid/dustpan component 14. The dustpan handle member 32 includes a base end 34 and a distal end 36, the base end 34 being pivotally connected to the end wall 30 of the dustpan 14. In general, the base end 34 of the dustpan handle 32 is wider than the distal end 36 thereof and has an opening 38 formed therethrough which is parallel to a planar surface of the end wall 30. A pair of mounting members 40 are fixed to the end wall 30 of the lid/dustpan 14 at a distance apart to receive the base end 30 of the dustpan handle 32 therebetween. The dustpan handle member 32 is generally hollow as shown at 37 for added lightness and for enabling fastening of the handle to another component if desired.

If the dustpan handle 32 will be used in combination with another component, such as an elongated handle member, then the hollow interior 37 of the dustpan handle 32 may be formed of threads for a threaded connection to the another component or by a snap fit interior for a snap fit with the another component. While threaded and snap fit connections are identified, it will be understood that these are given by way of example only, and the invention is intended to encompass any appropriate connection of the dustpan handle 32 to another component.

Each of the mounting members 40 has an aperture or opening 42 formed therein to receive an elongated pin or a hinge pin 44 therein. The elongated pin 44 extends through the opening 38 of the dustpan handle 32 and is secured at each end thereof within each of the mounting members 40, respectively. The opening 38 of the dustpan handle 32 is such that a free rotation of the handle about the elongated pin 44 is achieved. The pin may be of metal, plastic, or any other suitable material which will provide long wear and innumerable rotations of the handle therearound. The elongated pin may be fixed in the mounting members by screws or the like.

Alternatively, hinge pins (not shown) may extend from an outside end of each mounting member 40 and be inserted to a predetermined depth within the opening 38 of the handle base 34 so that the dustpan handle 32 may pivot freely as described. While inventive examples have been presented, it will be understood that the particular pivot connection of the dustpan handle 32 to the end wall 30 of the dustpan/lid 14 is not critical to an operation or understanding of the invention, and any suitable hinge type relationship is considered within the scope of the invention.

Still referring to the lid/dustpan 14, an entirety of a terminal edge 26*a* of the operating surface 26 is tapered to permit the easy sweeping of debris into the dustpan 14 and onto the operating surface 26 thereof. The terminal edge 26*a* may include an optional rubber surface piece or metal piece fixed thereto to assist in a transition to the operating surface 26 of the dustpan 14. If the terminal edge 26*a* of the operating surface 26 is not tapered, then any suitable transition piece may be mounted to obtain an angled transition from, for example, a floor to the operating surface 26 of the dustpan 14.

Figure 3:
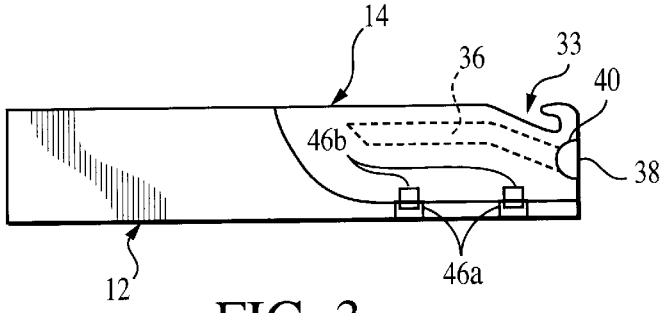
FIG. 3 is a side and partially transparent view of a closed cleaning kit according to the present invention.

Side walls 28 of the dustpan 14 are shaped to mate with the side walls 18 of the carrying portion 12, and the end wall 30 of the dustpan 14 defines a top end of the kit 10 in a closed condition. Essentially, the end wall 30 of the lid 14 will oppose the base end 20 of the carrying portion 12 once the lid is assembled with the carrying portion. When the lid 14 is assembled with the carrying portion 12, the result is shown in FIG. 3 as a compact and stowable kit. In particular, the dustpan handle member 32 of the dustpan/lid 14 will be folded against the operating surface 26 thereof as illustrated.

Figure 3A:
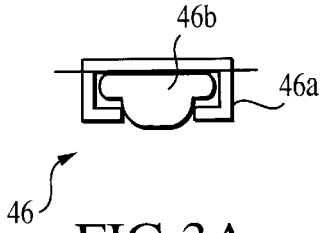
FIG. 3A illustrates detail of a connection.

In order to securely contain the contents of the kit 10 during either stowage or transportation, the lid 14 is selectively securable to the carrying portion 12 upon assembly by a locking or connecting device 46 capable of maintaining the lid 14 on the carrying portion 12. A locking device 46 for use in the present invention is shown in FIGS. 3 and 3A only in order to more clearly show a later described feature in FIG. 1. The locking device 46 is a sliding lock having at least one of a track portion 46*a* fixed to the carrier 12 and a corresponding sliding portion 46*b* sliding within the track portion 46*a*. A top view of the sliding lock 46 is shown in FIG. 3A. The sliding portion 46*b* engages with a lip of the lid or an additional aligned track portion (not shown) mounted on the lid, thereby securing the lid 14 to the carrying portion 12. While only two of the locking devices 46 are shown to be used on each side wall 18 of the carrying portion 12, additional locking devices may be employed according to a need for securement of the lid 14 to the carrying portion 12 of the kit 10.

Alternatively, it is contemplated that a friction fit type of connection between the carrying portion 12 and the lid/dustpan 14 may be used in addition to or independently of an external locking device as described above. More specifically, and as shown in FIG. 1, the inwardly facing surfaces of the sides 28 of the lid/dustpan 14 will include a plurality of male tabs 29 formed thereon. The inwardly facing surfaces of the carrying portion 12 at the tapered area 18*a* thereof include a short wall extension 27 having a female groove 31 formed in an outwardly facing surface thereof and aligned with the male tabs 29. The male tabs 29 are inserted into the corresponding female groove 31 as the lid 14 is seated on the carrying portion 12. The male tabs 29 essentially define a friction fit with the female groove 31, and may even be formed at a slight angle or with a slight narrowing of the female groove portion 31 to force the lid 14 down against the carrying portion 12 upon closing the components together in a set or finish position.

Further, it will be understood that many types of locking devices are known in the art, and it is intended that those types of locking arrangements be included within the specific scope of the invention since locking of the components together may be a user-specific function of the device.

An additional feature of the lid/dustpan portion 14 is the carrying handle 33 shown particularly in FIGS. 1 and 3. The carrying handle 33 may be recessed into the outer surface of the lid 14 in the general region of the dustpan handle member 32. There is sufficient space on the external surface of the lid 14 to form a deep grip area. When the components of the lid 14 and the carrying portion 12 are fit together but not locked, grasping of the carrying handle 33 enables an easy removal of the lid 14 from the carrying portion 12 and access to the interior of the housing. When the components of the carrying portion 12 and the lid 14 are locked together, then the grasping of the carrying handle 33 will enable carrying of the entire kit 10.

Figure 2:
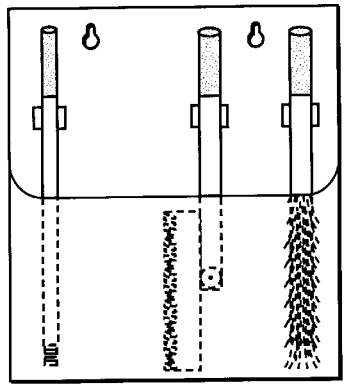
FIG. 2 is a top plan view of the cleaning kit with a portion of the housing removed and showing cleaning tools therein.

It is ideal to store at least a telescoping handle 50 and cleaning accessories having starter handles 52 within the carrying portion 12 of the kit 10. This level of assembly is shown in FIG. 2. In order to keep the handles 50 and 52 in place, plural grips 48 are provided mounted on a face surface of the rear wall 16 and arranged thereon to accommodate the cleaning accessories desired in a particular kit 10. The grips 48 may be of any suitable type to secure the telescoping handle 50 and starter handles 52 of the cleaning accessories within the housing. Contemplated grips 48 include clips that are molded as a one-piece construction, glued, welded or otherwise fixed to the face of the rear wall 16, or a hook-and-pile type fastener whose corresponding part is fixed to the telescoping handle 50 or the starter handles 52 of the cleaning accessories. The connection of and type of grips 48 will be appropriate to the material used to construct the kit and of a strength to hold the handle and accessories in place during transport or use of the kit. In some instances, it may be acceptable to simply store the cleaning components loosely in the kit, and in this case there will be no grips 48 required.

Figure 4:
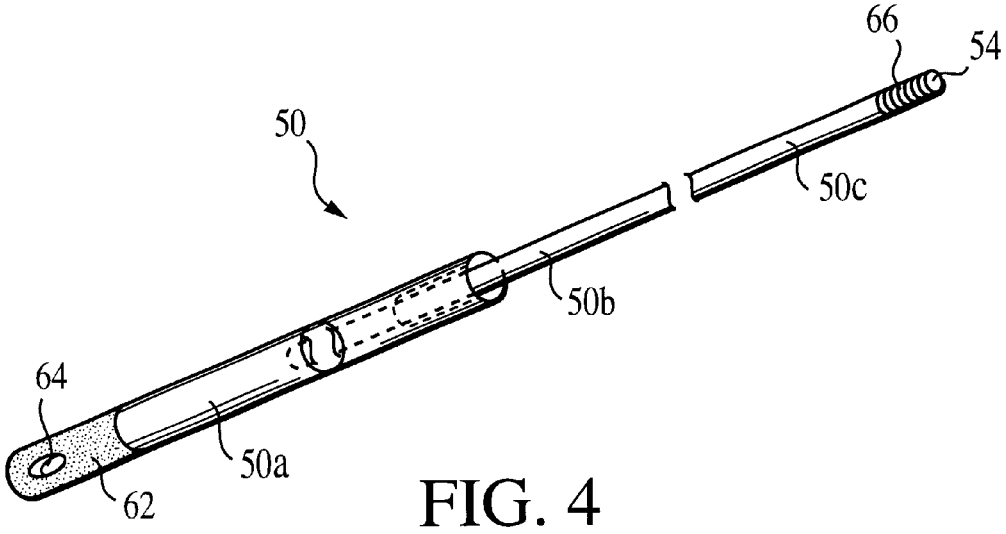
FIG. 4 is a perspective view of a telescoping handle according to the present invention.
Figure 5:
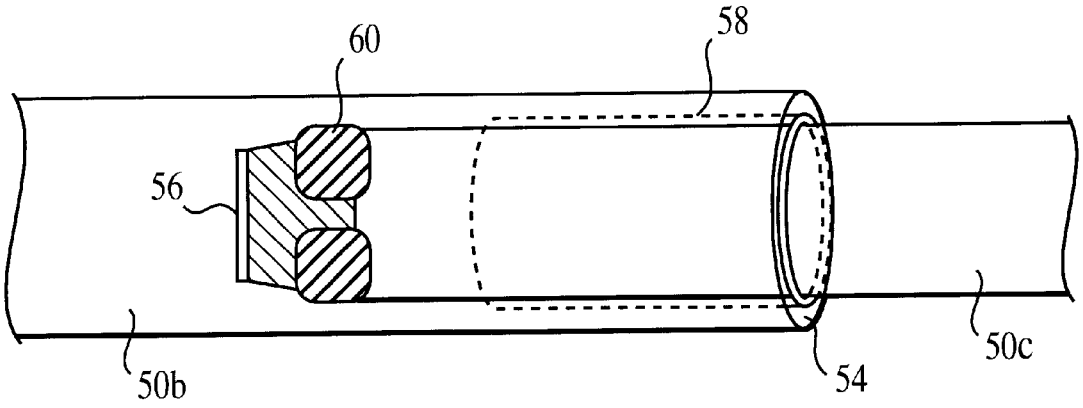
FIG. 5 is a detailed side sectional view of a portion of the telescoping handle of FIG. 4 in connection with the present invention.

The telescoping handle 50 of the present invention is shown in detail in FIGS. 4 and 5. In particular, the telescoping handle 50 includes at least two, and preferably three sections 50*a*, 50*b*, and 50*c* as shown. Each handle section is a hollow rod-like member, although the shape of the handle section is not critical except that all handle sections must have a similar cross-section. The hollow rods are each of their own constant diameter, and each subsequent rod is sequentially smaller in diameter along the overall length of the telescoping handle 50. This permits the complete sliding of a smaller section of the handle within an adjacent larger diameter handle section. For example, handle section 50*c* slides into handle section 50*b*, and handle section 50*b* further slides into handle section 50*a*. Further, for purposes of explanation, each handle section generally includes an exposed end 54 and an insertion end 56.

A nylon or similar type of inner sizing ring 58 is glued, welded or otherwise fixed to an inner surface of each section 50*a*, 50*b*, and 50*c* adjacent the exposed end 54 thereof. The inner sizing ring 58 not only prevents a smaller diameter section from being fully extracted from the section into which it is inserted, but also adds support to the telescoping handle 50 when the sections are all fully extracted.

The inner sizing ring 58 can be of any length to permit easy fixing on the inner surface of the handle section, and inner ring members 58 of a substantially longer length will assist in providing additional structural stability/strength to the extended handle sections 50*a*, 50*b*, and 50*c*.

A tightening nut 60 is mounted on the insertion end 56 of each handle section 50*b*, 50*c*. By turning adjacent handle sections in opposite directions, the tightening nut 60 will tighten within each section to construct a sturdy telescoped handle 50. Also, the tightening nut 60 prevents extraction of, for example section 50*c* from section 50*b*, by abutting against the end of the inner sizing ring 58 fit within the exposed end 54 of the handle section 50*b*.

The largest or radially outermost handle section, here shown as 50*a*, includes a grip end 62 formed thereon. The grip end 62 is preferably formed of plastic, rubber or other similar comfort material and fits over the outer end of the handle section. It is possible to provide an opening 64 in the grip 62 such that the telescoping handle 50 may be optionally hung on a hook or the like. Further, it will be understood that the material used to make the handle sections may be of a material that will not need a grip end or that the grip may be fashioned out of the end of the handle section 50*a* per se.

The innermost handle section having the smallest diameter, here shown as section 50*c*, is that handle section having a cleaning tool attachment surface 66 at the exposed end 54 thereof. The attachment surface 66 shown is a threaded or screw-type end. This threaded "male" end 66 will engage with any corresponding threaded "female" end of a cleaning tool starter handle 52 as will be described below. Accordingly, any starter handle 52 for a tool is interchangeable on the telescoping handle 50.

Alternatively, the male end 66 and the female end of any of the connectable components of the present invention may be of a friction or tight slide fit, a push and twist fit, snap-fit connection, magnetic connection, or other similar type of quick-connect arrangement. The ultimate goal is a quick and easy connection of components having the ability to easily interchange with each other over a long lifetime.

The structure and concept of the telescoping handle may additionally be implemented in connection with other parts of the disclosure. For example, it would be possible to provide a telescoping handle for the dustpan handle 32, or alternatively provide a telescoping handle in place of the handle 32 of the dustpan. Likewise, even though it is stated that the cleaning implements include starter handles 52, these starter handles 52 may alternatively be made as telescoping handles. This significantly increases the manufacturing and sale options of the kit and enables a kit to be customized to a customer's needs.

Figure 6:
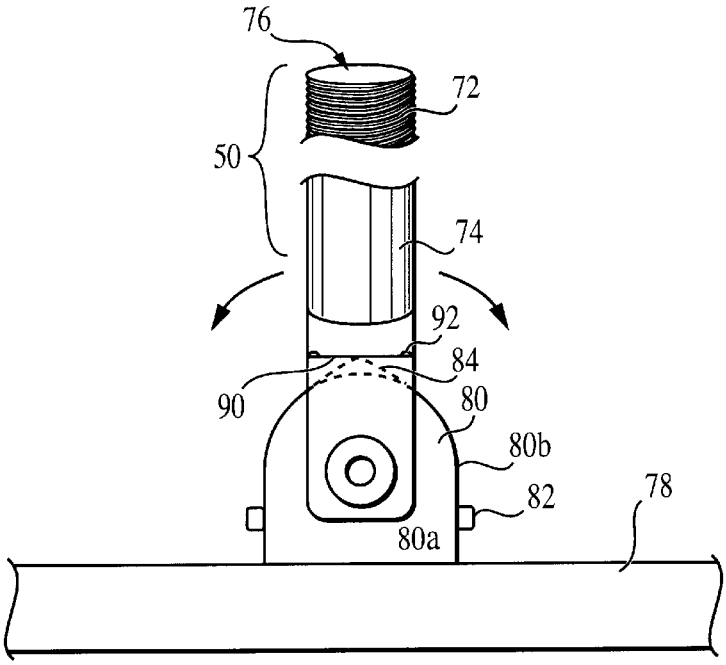
FIG. 6 is a front view of a hinge connection of the present invention.
Figure 7:
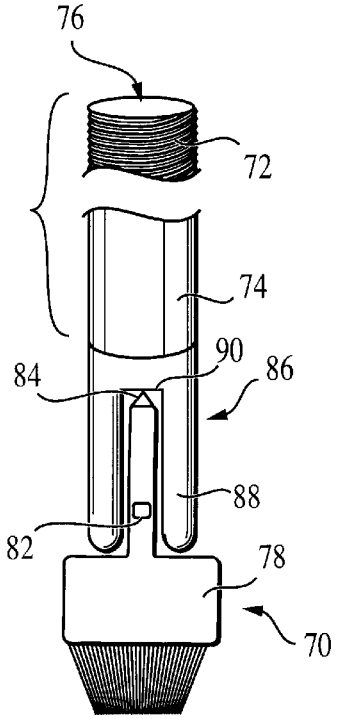
FIG. 7 is an end view of the hinge connection shown in FIG. 6.

Turning now to FIGS. 6 and 7, a pivotal connection of the starter handle 52 to a head 78 of a cleaning tool is shown and described. The particular cleaning tool illustrated is a broom (FIG. 10) and is given by way of example, it being understood that virtually any cleaning tool may be pivotally attached to the starter handle 52 as described or pivotally attached to a telescoping handle 50 instead.

In the present invention, all cleaning tools preferably include both a cleaning implement 70 and the starter/attachment handle 52. Each starter handle 52 has a first end 72 and an implement end 74. The first end 72 of the starter handle 52 is that portion which connects to the telescoping handle 50. The implement end 74 of the starter handle 52 is that end which connects to the cleaning implement 70. It should be understood that the connection of the implement end 74 to the implement 70 may either be fixed or pivotal, depending upon the size and orientation of the implement. For example, the brush (FIG. 10) and squeegee (FIG. 11) will need to be folded against the starter handle 52 due to their size, thus necessitating the pivot connection. The duster (FIG. 12) may simply be fixed to the implement end 74 of the starter handle 52. The pivotal connection is that which will be described herein as the fixed connection is simply any suitable extension of the starter handle 52.

As shown in FIGS. 6 and 7, the first end 72 of the starter handle 52 is internally threaded at 76. This threaded portion 76 provides a female end into which the threaded male end 66 of the telescoping handle 50 will engage. This end portion 72 may either be made initially hollow or formed out according to the material used to make the starter handle 52. Alternatively, an internally threaded grip (rubber or otherwise) is fixed to the first end 72 of the starter handle 52 and will operate in the same manner as described above. While the description and figures show the use of a threaded handle and connection between the starter handle 52 and the telescoping handle 50, it is possible to use any type of connection known in the art. By way of example, any of a snap fit, magnetic, or other known connection may be used to secure the starter handle 52 to the telescoping handle 50.

The pivot connection of the implement end 74 to a cleaning implement 70 is as follows. The cleaning brush or other implement 70 is supported by a head member 78. The head member 78 includes an arcuate and disc-shaped pivot portion 80 connected thereto either as a one-piece configuration or separately attached. The pivot portion 80 includes faces 80*a* spanned by an arcuate band 80*b* extending from the surface of the head member 78. The arched band portion 80*b* includes at least two ribs 82 on the outer side surfaces thereof adjacent each end of the arch, and at least one rib 84 on a tip thereof.

A hinge connection 86 is attached to the implement end 74 of the starter handle 52 and is of a substantially "U" shape. Depending legs 88 of the hinge connection 86 are pivotally secured to opposing side faces 80*a* of the pivot member 80 such that the starter handle 52 pivots about a longitudinal axis of the brush or cleaning tool 70. A base 90 of the "U" includes detents 92 formed therein at open sides of the "U" so as to engage with the ribs 82 of the pivot member 80. Thus, the starter handle 52 may be "locked" down against the head portion 78 of a cleaning tool 70 so as to be in parallel alignment therewith for storage purposes.

Further, the rib 84 on the top of the pivot portion 80 is of a height to engage with an inner surface of the base 90 of the "U" on the hinge connection 86. Thus, the starter handle 52, when extended, will remain in place for use of the implement 70 due to a friction fit of the top rib 84 and inner base surface 90 of the "U". An application of pressure greater than the friction fit will enable collapse of the starter handle 52 against the head 78 of the cleaning tool 70.

Figure 8:
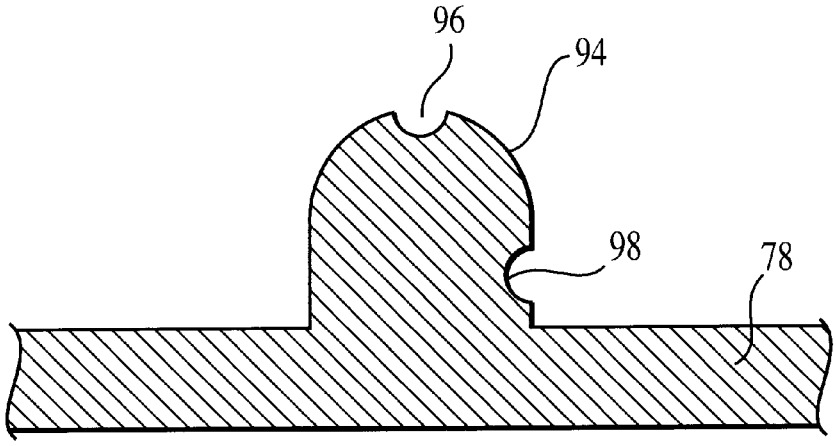
FIG. 8 is a front view of an alternative pivot for a hinge connection according to the present invention.
Figure 9:
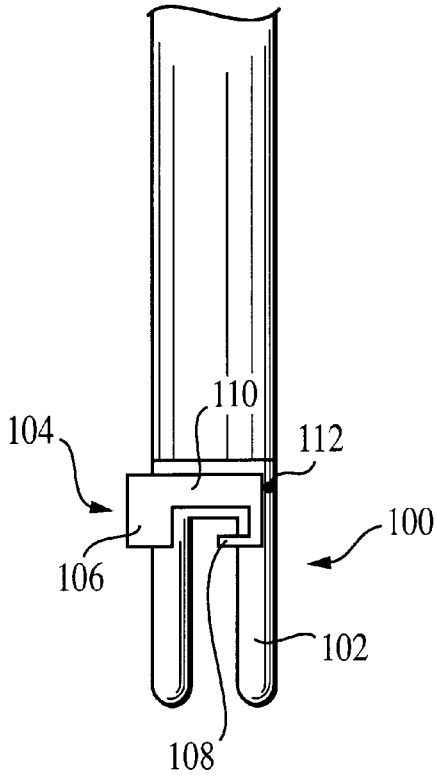
FIG. 9 is an end view of the alternate hinge for the alternate pivot of FIG.8.

An alternative pivot connection is now shown in FIGS. 8 and 9. In particular, a disc shaped member 94 is fixed to the head 78 of the cleaning implement as previously described. The alternative disc shaped member 94 includes two notched portions 96, 98, with one notched portion 96 at a distal end of the disc and another 98 on an edge of the disc adjacent the head portion 78 of the cleaning implement. A hinge connection 100 of the starter handle 52 is of a substantially "U" shaped member with depending legs 102. A separate locking button 104 is formed through the hinge connection 100 near the base of the "U", or at the inner ends of the depending legs 102. The locking button 104 has an external button 106 and an internal locking projection 108 connected to the button by a bar 110 therebetween as shown.

Compression of the button 106 is resisted by an opposing bias spring 112 and will disengage the locking projection from a respective notch 96, 98 so as to enable pivoting of the starter handle around the disc 94. This pivot motion will place the starter handle 52 in either an extended or folded position with respect to the implement head and lock the starter handle 52 in whatever position it is placed. This is an equally effective pivot and locking connection to the first such connection described and is presented as an equivalent alternative thereto.

Figure 10:
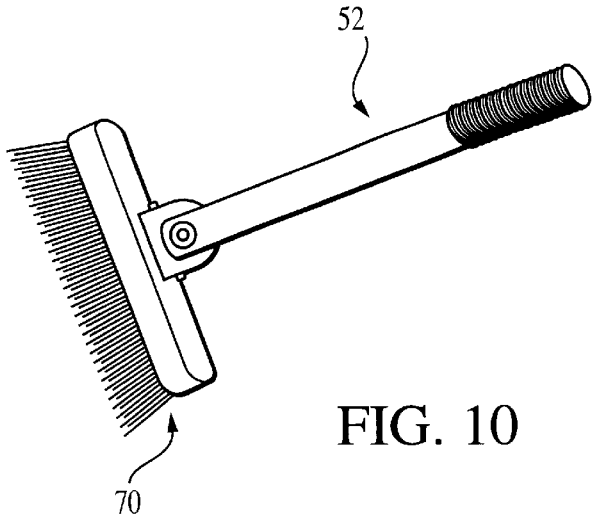
FIG. 10 is a perspective view of a broom-type tool according to the present invention.
Figure 11:
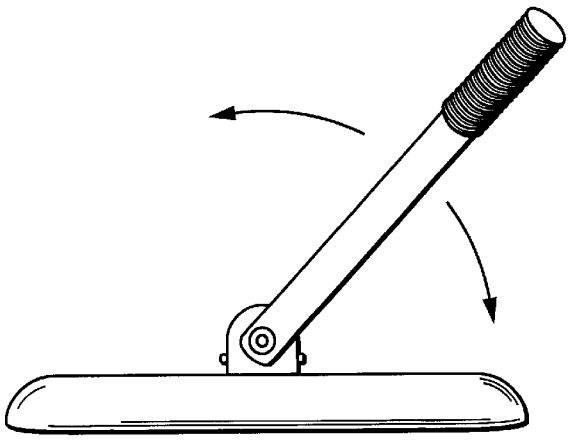
FIG. 11 is a perspective view of a squeegee-type tool according to the present invention.
Figure 12:
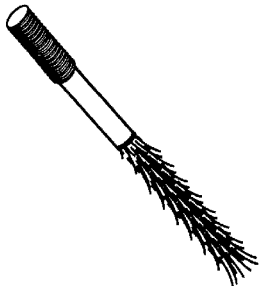
FIG. 12 is a perspective view of a duster-type tool according to the present invention.

FIGS. 10 through 12 illustrate possible cleaning tools including a broom (FIG. 10), a squeegee (FIG. 11), and a duster (FIG. 12).

All kits will contain at least a telescoping handle member 50 for connection to a broom for use in combination with the dustpan 14. The remaining cleaning elements in the kit may be varied depending upon a purchaser's needs.

It will be understood that the telescoping handle member 50 is desired for the purpose of conserving space in the kit housing by reducing these cleaning accessories to a single compact space.

Additionally, there may be instances where, for the purpose of saving space or the like, it is necessary to supply cleaning tools which do not have starter handles 52 assembled therewith. Such an instance does not negate the remaining features and functions of the present invention, and it is merely acknowledged as an alternative to the construction described in detail herein.

By way of further explanation regarding optional modifications and embodiments, it is intended that the telescoping handle 50 will include three sections, although more or less may be desirable in certain conditions. The container kit itself is made of plastic or a lightweight material that will not substantially add to the weight of the cleaning components therein. The size of the kit can be altered at construction thereof to hold more or less cleaning items. For example, the closed housing may be approximately 17 inches long, 3 inches high, and 12 inches wide. This is sufficient space to accommodate all accessories comfortably, yet allow the housing to fit in a drawer or other compact space.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. A cleaning kit comprising:

a housing member, said housing member including a carrier and a convertible cover;

a pivotal handle fixed to an inner surface of said convertible cover, said pivotal handle being selectively folded against the inner surface of said convertible cover;

at least one connecting mechanism for securing said convertible cover to said carrier;

a telescoping handle removably stored in the carrier of said housing;

a at least one cleaning device removably stored in the carrier of said housing, said at least one cleaning device including an attachment head, a handle having a first end and a pivot end, and a pivot hinge positioned between the attachment head and the pivot end of the handle, the handle being selectively folded against and parallel to the attachment head, wherein said convertible cover selectively functions as one of a cover and a dustpan.

2. The cleaning kit according to claim 1 wherein said convertible cover and said carrier form a substantially rectangular housing upon fitting of said cover to said carrier.

3. The cleaning kit according to claim 1 wherein said carrier includes a rear wall, a front wall shorter than the rear wall, a base end, and side walls, said side walls having a constant dimension from the base to an open edge of the front wall and a reducing height from the open edge of the front wall to an open edge of the rear wall.

4. The cleaning kit according to claim 3 wherein said convertible cover includes a primary surface, side walls at opposing side edges of the primary surface, and an end wall on one remaining edge of the primary surface, wherein an open end of said convertible cover mates with the front wall of said carrier, the end wall opposes the base of said carrier, and an open edge of the side walls mate with the reducing dimension of said carrier side walls.

5. The cleaning kit of claim 1, wherein said at least one connecting mechanism includes a wall portion extending from an inner surface of each of the side walls and having a female groove formed on an outwardly facing surface thereof, and plural aligned tab members positioned on an inner surface of each of the cover side walls, the plural tab members engaging with a corresponding female groove, respectively, upon seating the convertible cover on the carrier.

6. The cleaning kit according to claim 1, wherein said connecting mechanism includes a slide lock mounted to the carrier and engageable with the convertible cover, thereby securing the convertible cover to the carrier.

7. The cleaning kit according to claim 1 wherein said at least one connecting mechanism includes: a first connecting mechanism of a wall portion extending from an inner surface of each of the side walls and having a female groove formed on an outwardly facing surface thereof, and plural aligned tab members positioned on an inner surface of each of the cover side walls, the plural tab members engaging with a corresponding female groove, respectively, upon seating the convertible cover on the carrier; and a second connecting mechanism of a slide lock mounted to the carrier and engageable with the convertible cover, thereby securing the convertible cover to the carrier.

8. The cleaning kit according to claim 1 wherein said telescoping handle includes a predetermined number of hollow tubes of consecutively reduced diameter, each hollow tube having a step-down ring fixed to an inner peripheral surface at one end thereof, a locking nut formed on an outer peripheral surface at an opposite end thereof, wherein extension of a reduced diameter tube from an adjacent greater diameter tube is limited by abutment of said locking nut against said step-down ring, and wherein counter-rotation of adjacent tubes locks said adjacent tubes in place with respect to each other.

9. The cleaning kit according to claim 8 further comprising a gripping surface at an exposed end of the relatively largest diameter tube and a threaded end fitting at an exposed end of the relatively smallest diameter tube.

10. The cleaning kit according to claim 8 wherein said step down ring is made of nylon.

11. The cleaning kit according to claim 1 wherein said pivotal handle includes a "U" shaped arm formed on one end of the handle, a hinge member mounted on the attachment head of said cleaning device, and a locking button for securing said pivotal handle in a predetermined position with respect to said hinge member.

12. The cleaning kit according to claim 11 wherein said hinge member includes opposing face portions and an arcuate outer surface joining the opposing face portions, said outer surface having a first detent adjacent a base of the outer surface, and a second detent at a mid point of the outer surface, and wherein each leg of said "U" shaped member is pivotally connected to an opposing face of said hinge such that a portion of the locking button will engage with the second detent upon complete rotation of the handle to an orientation parallel with the attachment head and the same portion of the locking button will engage with the second detent at the mid point of the outer surface for retaining the handle in an extended position perpendicular to the attachment head.

13. The cleaning kit according to claim 1, further comprising a plurality of holding clips mounted on an inner surface of said carrier, each of said holding clips retaining a handle of one of said telescoping member or the handles of said at least one cleaning device.

* * * * *